United States Patent [19]

Baumann

[11] Patent Number: 4,582,649

[45] Date of Patent: Apr. 15, 1986

[54] PHENOLAMINES

[75] Inventor: Hans-Peter Baumann, Ettingen, Switzerland

[73] Assignee: Sandoz Ltd., Basel, Switzerland

[21] Appl. No.: 675,621

[22] Filed: Nov. 28, 1984

[51] Int. Cl.[4] ..... C07C 91/16; C07C 91/18; H01C 13/00

[52] U.S. Cl. ..... 260/501.21; 260/501.15; 260/501.16; 564/360; 564/361; 564/355

[58] Field of Search ..... 260/501.21, 501.15, 260/501.16; 564/360, 361, 355

[56] References Cited

FOREIGN PATENT DOCUMENTS 877948 9/1961 United Kingdom .
1098416 1/1968 United Kingdom .
2018771 10/1979 United Kingdom .

*Primary Examiner*—Glennon H. Hollrah
*Assistant Examiner*—Raymond Covington
*Attorney, Agent, or Firm*—Gerald D. Sharkin; Richard E. Vila; Thomas C. Doyle

[57] ABSTRACT

Compounds of formula I

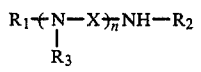

I in which $R_1$ is an aliphatic $C_{6-22}$ residue $R_2$ is an optionally substituted salicyl group each $R_3$, independently, is H or an optionally substituted salicyl group n is 0 or an integer from 1 to 10 each X, independently, is $—C_2H_4—$ or $—C_3H_6—$ provided that the molecule contains from 1 to 5 optionally substituted salicyl groups in free base, protonized or quaternized form, are useful as dyeing or printing after-treatment agents, particularly to improve the oxidative wet fastness of dyeings or printings on cellulose containing material.

13 Claims, No Drawings

PHENOLAMINES

The invention relates to phenolamines, which are useful as dyeing or printing after-treatment agents, particularly to improve the oxidative wet fastness of dyeings or printings on cellulose material.

According to the invention, there is provided a process for after-treating a dyed or printed textile substrate comprising cellulosic fibres, which process comprises bringing the dyed or printed substrate into contact with a compound of formula I

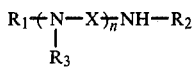

I in which $R_1$ is an aliphatic $C_{6-22}$ group $R_2$ is a group of formula (a)

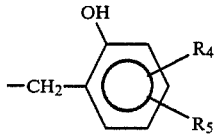

(a)

each $R_3$, independently, is hydrogen or a group of formula (a)

each $R_4$, independently, is hydrogen or $C_{1-12}$ alkyl each $R_5$, independently, is hydrogen, chlorine, $C_{1-12}$alkyl, cycloalkyl or phenyl n is 0 or an integer from 1 to 10 each X, independently, is $—CH_2H_4—$ or $—C_3H_6—$ provided that the molecule contains from 1 to 5 groups of formula (a) in free base, protonized or quaternized form.

The aliphatic residue as $R_1$ may be saturated or unsaturated. It is preferably a linear or branched $C_{6-22}$alkyl or $C_{6-22}$alkenyl group, more preferably $C_{12-18}$alkyl or $C_{12-18}$alkenyl, particularly cetyl, stearyl or a mixture of $C_{14-18}$ alkyl and/or alkenyl derived from reduced natural fatty acids such as tallow fatty acid.

Any alkyl as $R_4$ or $R_5$ may be straight or branched chain; alkyl is preferably $C_{1-4}$alkyl, particularly methyl or ethyl.

Any cycloalkyl as $R_5$ is preferably cyclohexyl.

When $R_4$ is alkyl, it is preferably in the ortho or meta position to the hydroxy. When $R_5$ is other than hydrogen, it is preferably in the para position to the hydroxy. Preferably $R_4$ and $R_5$ are each hydrogen.

Preferably the group of formula (a) is salicyl.

When X is $—C_3H_6—$, it may be linear or branched.

n is preferably an integer from 1 to 10. More preferably n is 1, 2, 3 or 4, particularly 3 or 4.

Preferred compounds of formula I are those in which $R_1$ is $C_{12-18}$ alkyl or $C_{12-18}$ alkenyl, $R_2$ is salicyl, each $R_3$ independently is hydrogen or salicyl, X is $—C_3H_6—$ and n is 1, 2, 3 or 4, the molecule containing 1, 3 or 4 salicyl groups.

Further preferred compounds of formula I are those in which $R_1$ is cetyl, stearyl or tallow fatty residue, $R_2$ is salicyl, X is $—C_3H_6—$ and either n is 3 and $R_3$ is salicyl or n is 4 and one $R_3$ is hydrogen and the remaining $R_3$'s are each salicyl.

The nature of the anion of the protonized or quaternized compounds of formula I is not critical. Preferred anions are halogenide, e.g. $Cl^-$ or $Br^-$, benzenesulphonate, p-toluenesulphonate, formate, sulphate, methylsulphate or phosphate. More preferred are $Cl^-$ and formate, especially $Cl^-$.

Compounds of formula I in which n is an integer from 1 to 10, in free base, protonized or quaternized form are novel and form part of the invention.

Compounds of formula I may be prepared by reacting one mol of an amine of formula II $$R_1—NH—X)_nNH_2 \qquad \text{II}$$

in which $R_1$, X and n are as defined above, or a mixture thereof, with 1 to n+1 mole formaldehyde and 1 to n+1 mole of a compound of formula III

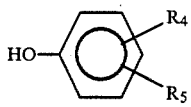

III in which $R_4$ and $R_5$ are as defined above, or a mixture of compounds of formula III, the formaldehyde and the compound of formula III being each reacted in equimolar amounts, and, where desired, converting the resulting compounds of formula I obtained in free base form into a protonized or quaternized form or vice versa.

The reaction may be carried out according to known methods, e.g. according to a Mannich-condensation.

The resulting compounds of formula I in free base form may be protonized by reaction with an organic or mineral acid, e.g. benzenesulphonic acid, p-toluenesulphonic acid, hydrochloric acid, hydrobromic acid, phosphoric acid etc., or quaternized by reaction with a quaternization agent, e.g. dimethylsulphate, methyl chloride, benzyl chloride etc. Depending on the amount of acid or quaternization agent used, it is possible to protonize or quaternize one, several or all of the basic nitrogen atoms present in the molecule (depending on the value of n).

The compounds of formula I, in free base or in salt form, may be obtained in liquid, pasty or solid form depending on their nature. They may be purified according to known methods.

The compounds of formula I are useful as dyeing or printing after-treatment agents, in particular for after-treating dyeings or printings on cellulose containing textile material to improve their oxidative wet fastness.

Cellulose containing textile material includes substrates which comprise natural and/or regenerated cellulose, preferably cotton. The substrate may be in any conventional form, e.g. yarn, woven or knitted goods, fully finished articles etc.

The compounds of formula I are applied to the textile substrate after dyeing or printing. Dyeing or printing is carried out according to known methods with direct or reactive dyestuffs. After fixation of the dyestuffs the textile substrate is advantageously washed or rinsed.

The compounds of formula I may be applied to the dyed or printed textile substrate by known methods, for example by impregnation, e.g. padding, or by the exhaust method. The liquor to goods ratio is suitably from 0.7:1 to 60:1. The application may be effected at a temperature from room temperature to 100° C. In the case of impregnation, fixation is carried out according to known methods, at a temperature from room temperature to approx. 180° C.

The application of the compounds of formula I may be suitably effected at a pH of from 4 to 7. It may then be advantageous to add an alkaline reacting agent, e.g. sodium trichloracetate, to the treatment liquor.

Suitably the treatment liquor contains from 0.1 to 10 g/l of a compound of formula I, preferably from 0.5 to 5 g/l when the compound of formula I is applied by the exhaust method. The padding solutions suitably contain from 1 to 100 g/l, preferably from 10 to 80 g/l, most preferably from 10 to 60 g/l of compound of formula I.

Depending on their solubility in water, the compounds of formula I may be added as such to the treatment liquor or admixed first with a solubilising agent, e.g. a glycol such as ethylene glycol or a glycol monoether, e.g. butyl diethylene glycol or propyl ethylene glycol.

After the treatment with a compound of formula I the textile substrate is dried.

Dyeings or printings after-treated with a compound of formula I have an improved oxidative wet fastness, in particular improved fastness to chlorine water. This fastness property is nowadays of increasing importance since the tap water used for washing has an increasing chlorine content. Swimming pool water also has a high chlorine content. Cellulose dyeings or printings obtained with conventional dyestuffs are sensitive to the deleterious action of chlorine water and this action is even stronger when the goods are washed warm.

The following Examples, in which all parts and percentages are by weight as far as not otherwise indicated, illustrate the invention. The temperatures are given in degrees Centigrade.

EXAMPLE 1

455 Parts amine of formula $$H_{37}C_{18}(NH—CH_2—CH_2—CH_2—_4NH_2$$

and 376 parts phenol are introduced in a flask fitted with a reflux condenser and heated to 90°. 120 Parts paraformaldehyde are then added portionwise to the mixture while stirring and maintaining the temperature below 100°. After 5 hours stirring at 95°-100° the water resulting from the reaction is removed by distillation at 80° under approx. 20 mm Hg. The vacuo is then stopped and the mixture is heated at 85° with vigorous stirring. To this mixture is added first and slowly 341 parts concentrated HCl (pH≦3) and then 978 parts ethyleneglycol. After cooling to approx. 20° while stirring, the resulting product is, if necessary, adjusted to pH 3. The resulting phenolamine of formula

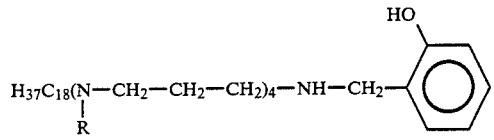

in which one R is hydrogen and the remaining R's are each salicyl, can be used as such as a solution in ethyleneglycol for the after-treatment.

By repeating the procedure of Example 1 but using the amines, phenol and formaldehyde in the amounts indicated in the following Table, further phenolamines of formula I can be produced.

TABLE

| Ex. No. | Amine | Moles Phenol | Moles $CH_2O$ | converted into salt form with |
|---|---|---|---|---|
| 2 | $C_6H_{13}—NH_2$ | 1 | 1 | 1 mol dimethylsulphate |
| 3 | $C_{12}H_{25}NH_2$ | 1 | 1 | 1 mol dimethylsulphate |
| 4 | tallow fatty($C_{14-18}$)-amine | 1 | 1 | 1 mol dimethylsulphate |
| 5 | $C_{18}H_{37}—NH—C_3H_6—NH_2$ | 1 | 1 | 1 mol dimethylsulphate |
| 6 | $C_{18}H_{37}—(NH—C_3H_6)_2—NH_2$ | 1 | 1 | 1 mol dimethylsulphate |
| 7 | " | 1 | 1 | 1 mol dimethylsulphate |
| 8 | $C_{18}H_{37}(NHC_3H_6)_3—NH_2$ | 1 | 1 | 1 mol dimethylsulphate |
| 9 | " | 1 | 1 | 1 mol dimethylsulphate |
| 10 | $C_{18}H_{37}(NHC_3H_6)_4—NH_2$ | 1 | 1 | 1 mol HCOOH |
| 11 | " | 1 | 1 | 1 mol HCL |
| 12 | tallow fatty residue-$(NHC_3H_6)_4—NH_2$ | 1 | 1 | 1 mol dimethylsulphate |
| 13 | $C_{18}H_{37}—NHC_3H_6NHC_2H_4—NHC_3H_6NH_2$ | 1 | 1 | 1 mol dimethylsulphate |
| 14 | tallow fatty-amine | 1 | 1 | free base |
| 15 | $C_{12}H_{25}—NHC_3H_6(NHC_2H_4)_2—NHC_3H_6NH_2$ | 1 | 1 | 1 mol $CH_3Cl$ |
| 16 | tallow fatty residue-$(NHC_3H_6)_4—NH_2$ | 2 | 2 | free base |
| 17 | tallow fatty residue-$(NHC_3H_6)_4—NH_2$ | 1 | 1 | free base |
| 18 | $C_{18}—H_{37}—(NHC_3H_6)_4—NH_2$ | 4 | 4 | 1 mol HCL |

APPLICATION EXAMPLE A

Bleached cotton fabric is dyed at 40° for 90 minutes with an aqueous dyebath containing 1.9% dyestuff C.I. Reactive Red 123 (based on the dry weight of the fabric), and, per 1000 parts, 50 parts calc. sodium sulphate and 20 parts calc. sodium carbonate. The liquor to goods ratio is 20:1.

After dyeing the fabric is thoroughly rinsed with warm and cold water. Thereafter the fabric is soaped at the boil for 20 minutes with a solution containing, per 1000 parts, 0.5 part of a commercially available soaping agent based on carboxymethylated alkylene oxide addition product and then rinsed with warm water.

The resulting fabric is then treated at room temperature for 20 minutes with an aqueous liquor containing per 1000 parts 3 parts of the product obtained in Example 1. The liquor to goods ratio is 20:1. After drying, there is obtained a scarlett red dyeing having a good chlorine water fastness at 83° (measured according to SNV 195.828).

Similar good results are obtained when the after-treatment of the reactive dyeing is effected with the products of Examples 2 to 18 instead of the product of Example 1.

APPLICATION EXAMPLE B

Mercerised knitted cotton goods are dyed at 98° for 60 minutes with an aqueous dyebath containing 1% dyestuff C.I. Reactive Blue 79 (based on the dry weight of the goods) and, per 1000 parts, 60 parts sodium chloride, 15 parts calc. sodium carbonate and 1 part sodium n-nitrobenzenesulphonate. The liquor to goods ratio is 40:1.

After dyeing, the goods are thoroughly rinsed with warm and cold water. They are then soaped and rinsed as disclosed in Example A above. Thereafter the goods are treated at 98° for 20 minutes with an aqueous liquor containing per 1000 parts 1.5 parts of the compound of Example 13 (without ethyleneglycol) and 5 parts sodium trichloroacetate. The liquor to goods ratio is 20:1. After drying, a blue dyeing having an excellent fastness to chlorine water (according to SNV 195.822) is obtained. The chlorine water fastness is also good after two washings at 60° (according to SNV 195.813).

APPLICATION EXAMPLE C

Bleached knitted cotton goods are dyed at 40° for 60 minutes with an aqueous dyebath containing

| | |
|---|---|
| 0.33% dyestuff C.I. Reactive Orange 91<br>0.40% dyestuff C.I. Reactive Red 184<br>0.20% dyestuff C.I. Reactive Blue 184 | based on the dry weight of the goods |
| and, per 100 parts, 60 parts calc. sodium sulphate<br>1 part calc. sodium carbonate, and<br>2 parts (in volume) 36% sodium hydroxide. | |

The liquor to goods ratio is 20:1.

The goods are then rinsed, soaped and after-treated as disclosed in Example B above.

The resulting beige dyeing has a good chlorine water fastness.

APPLICATION D

Bleached cotton fabric is dyed according to the procedure of Example A above but using the following dyestuffs:

| | |
|---|---|
| 6.4% dyestuff C.I. Reactive Yellow 25<br>3.5% dyestuff C.I. Reactive Red 147<br>1.4% dyestuff C.I. Reactive Blue 193 | based on the dry weight of the goods. |

After rinsing, soaping and rinsing the goods are treated at 60° for 20 minutes with an aqueous liquor containing, per 1000 parts, 2 parts of the compound of Example 18. The liquor to goods ratio is 20:1.

The resulting dyeing has a very good chlorine water fastness at 83°. This property is still maintained after three successive washings with chlorine water.

Similar good results are obtained when the dyed substrate is padded with an aqueous liquor containing/1000 parts, 20 parts of the compound of Example 18, squeezed to 80% of the substrate dry weight and dried at 120°.

APPLICATION EXAMPLE E

Bleached cotton cretonne is dyed at 98° for 90 minutes with an aqueous dyebath containing 2% dyestuff C.I. Direct Red 207 based on the dry weight of the substrate and 15 parts calc. sodium sulphate per 1000 parts. The liquor to goods ratio is 20:1.

After thoroughly rinsing with cold water, the substrate is after-treated at 60° for 15 minutes with an aqueous liquor containing per 1000 parts 2 parts of the compound of Example 16 (without ethylene glycol) and then dried.

The resulting bordeaux dyeing exhibits a good chlorine water fastness.

The same good results are obtained when the substrate dyed with 3% dyestuff C.I. Direct Blue 199 is after-treated according to the same procedure.

By following the same procedure as indicated in Examples B-D but using the compounds of the other Examples, dyeings with good chlorine water fastness are obtained.

What is claimed is:

1. A compound of formula I

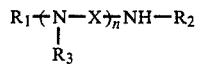

I in which $R_1$ is an aliphatic $C_{6-22}$ group $R_2$ is a group of formula (a)

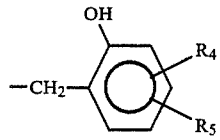

(a)

each $R_3$, independently, is hydrogen or a group of formula (a)

each $R_4$, independently, is hydrogen or $C_{1-12}$ alkyl each $R_5$, independently, is hydrogen, chlorine, $C_{1-12}$alkyl, cycloalkyl or phenyl n is an integer from 1 to 10 each X, independently, is $—C_2H_4—$ or $—C_3H_6—$, provided that the molecule contains from 1 to 5 groups of formula (a), in free base, protonized or quaternized form.

2. A compound according to claim 1, in which $R_4$ and $R_5$ in the group of formula (a) are hydrogen.

3. A compound according to claim 1, in which $R_1$ is $C_{12-18}$-alkyl or $C_{12-18}$alkenyl, $R_2$ is salicyl, each $R_3$, independently, is hydrogen or salicyl, X is $—CH_3H_6—$ and n is 1, 2, 3 or 4, the molecule containing 1, 3 or 4 salicyl groups.

4. A compound according to claim 1, in which $R_1$ is stearyl, cetyl or tallow fatty residue, $R_2$ is salicyl, X is $—C_3H_6—$ and either n is 3 and $R_3$ is salicyl or n is 4 and one $R_3$ is hydrogen and the remaining $R_3$'s are each salicyl.

5. A compound according to claim 1, of formula

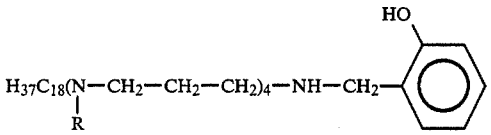

in which one R is hydrogen and the remaining R's are each salicyl.

6. A compound according to claim 1, in which when the compound is protonized or quaternized, the anion of such a form is halogenide, benzenesulphonate, p-toluenesulphonate, sulphate, methylsulphate, phosphate or formate.

7. A compound according to claim 1 wherein each $R_1$ is linear or branched $C_{6-22}$alkyl or $C_{6-22}$alkenyl, each $R_4$, independently, is hydrogen or $C_{1-4}$alkyl, and each $R_5$, independently, is hydrogen, chlorine, $C_{1-4}$alkyl, cyclohexyl or phenyl, provided that when $R_4$ is $C_{1-4}$alkyl it is ortho or meta to the hydroxy and when $R_5$ is other than hydrogen it is para to the hydroxy.

8. A mixture of compounds according to claim 1.

9. A mixture of compounds according to claim 2.

10. A mixture of compounds according to claim 3.

11. A compound according to claim 3 in which, when the compound is protonized or quarternized the anion is halogenide, benzenesulphonate, p-toluenesulphonate, sulphate, methylsulphate, phosphate or formate.

12. A mixture of compounds according to claim 4.

13. A mixture of compounds according to claim 7.

* * * * *